US006221112B1

(12) United States Patent
Snider

(10) Patent No.: US 6,221,112 B1
(45) **Date of Patent: *Apr. 24, 2001**

(54) PROCESS FOR PRODUCING A COLORED POLYESTER FILM

(75) Inventor: William Douglas Snider, Repton (GB)

(73) Assignee: CP Films, Inc., Martinsville, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 73 days.

(21) Appl. No.: 09/183,993

(22) Filed: Nov. 2, 1998

Related U.S. Application Data

(63) Continuation of application No. 08/960,731, filed on Oct. 29, 1997, now abandoned, which is a continuation of application No. 08/801,031, filed on Feb. 19, 1997, now abandoned, which is a continuation of application No. 08/643,063, filed on Apr. 30, 1996, now abandoned, which is a continuation of application No. 08/443,688, filed on May 18, 1995, now abandoned, which is a continuation of application No. 08/090,887, filed on Jul. 12, 1993, now abandoned.

(30) Foreign Application Priority Data

Jul. 15, 1992 (GB) ..... 9215003

(51) Int. Cl.[7] ..... D06P 1/02

(52) U.S. Cl. ..... 8/470; 8/467; 8/495; 8/512; 8/552; 8/562; 8/933

(58) Field of Search ..... 8/467, 470, 471, 8/495, 512, 527, 528, 552, 562, 922, 933

(56) References Cited

U.S. PATENT DOCUMENTS

| | | | |
|---|---|---|---|
| 2,833,613 | 5/1958 | Hallada | 8/524 |
| 2,938,811 | 5/1960 | Hermes | 442/164 |
| 3,034,847 | 5/1962 | Chapman | 8/512 |
| 3,058,798 | 10/1962 | Iannarone | 8/151 |
| 3,512,913 | 5/1970 | Day | 8/512 |
| 3,637,340 | 1/1972 | Mollet | 8/552 |
| 3,956,559 | 5/1976 | Wildorf | 428/214 |
| 3,958,934 | 5/1976 | Jackson | 8/615 |
| 4,059,471 | 11/1977 | Haigh | 8/468 |
| 4,065,259 | 12/1977 | Jackson | 8/602 |
| 4,082,467 | 4/1978 | Kaplan | 401/199 |
| 4,094,634 | 6/1978 | Becker | 8/558 |
| 4,233,354 | 11/1980 | Hasegawa | 428/195 |

(List continued on next page.)

FOREIGN PATENT DOCUMENTS

| | | |
|---|---|---|
| 210310 | 1/1987 | (EP) . |
| 2318193 | 2/1977 | (FR) . |
| 2008034 | 5/1979 | (GB) . |

OTHER PUBLICATIONS

C. Hawkyard, "The Release of Disperse Dyes from Thickener Films During Thermal Processes", 7 pages, MS received Sep. 22, 1980.

(List continued on next page.)

*Primary Examiner*—Caroline D. Liott
(74) *Attorney, Agent, or Firm*—Howson and Howson

(57) ABSTRACT

A polyester film can be dyed by coating the film with a layer of a dye mixture which is a suspension of at least one disperse dyestuff in a solution of a thickener in water and which has a viscosity of no more than 500 centipoise, preferably 5–50 centipoise, at ambient temperature, followed by heating to cause the dyestuff to migrate from the layer into the film. The coating process is preferably reverse gravure printing. The process can be used to prepare films which contain one or more dyestuffs in one surface region of the film and one or more different dyestuffs, for example an ultraviolet absorber, in the other surface region of the film. The dyed films show good resistance to fading when exposed to light and are useful for example as automobile window films.

17 Claims, 1 Drawing Sheet

U.S. PATENT DOCUMENTS

| | | | |
|---|---|---|---|
| 4,288,493 | 9/1981 | Kropp | 428/350 |
| 4,297,099 | 10/1981 | Simon | 8/484 |
| 4,426,206 | 1/1984 | Hosokawa | 8/528 |
| 4,429,005 | 1/1984 | Penn | 428/350 |
| 4,502,867 | 3/1985 | Reinhardt | 8/557 |
| 4,668,239 | 5/1987 | Durand | 8/471 |
| 4,797,317 | 1/1989 | Oliver | 428/204 |
| 4,820,310 | 4/1989 | Fukui | 8/456 |
| 4,892,858 | 1/1990 | Nakamine | 8/471 |
| 5,154,953 | 10/1992 | Moncuit | 428/34 |

OTHER PUBLICATIONS

E. Flick, "Water–Soluble Resins, An Industrial Guide", p. 9, Noyes Publications, Park Ridge, NJ (1986) (no month available).

"Gravure Printing of Pet Films", *Courtaulds PLC Technical Information Services Coventry*, pp. 1–21 (Feb. 27, 1991).

"Printing and Polycarbonate and Film", *Courtaulds PLC Technical Information Services Coventry*, pp. 1–23 (May 26, 1993).

"U. S. Patents citing U. S. 3,034,847 (Du Pont Film Dyeing", *Courtaulds Research Technical Information Services Coventry*, pp. 1–3 (Jun. 7, 1991).

"Du Pont and Disperse Dying with Suspension", *Courtaulds Research Technical Information Services Coventry*, pp. 1–4 (Jun. 6, 1991).

"Pet and Gravure—1991 to date", *Courtaulds Research Technical Information Services Coventry*, pp. 1–36 (Jan. 29, 1992).

"Printing and Polyester and Film", *Courtaulds Research Technical Information Services Coventry*, pp. 1–49 (Jan. 29, 1992).

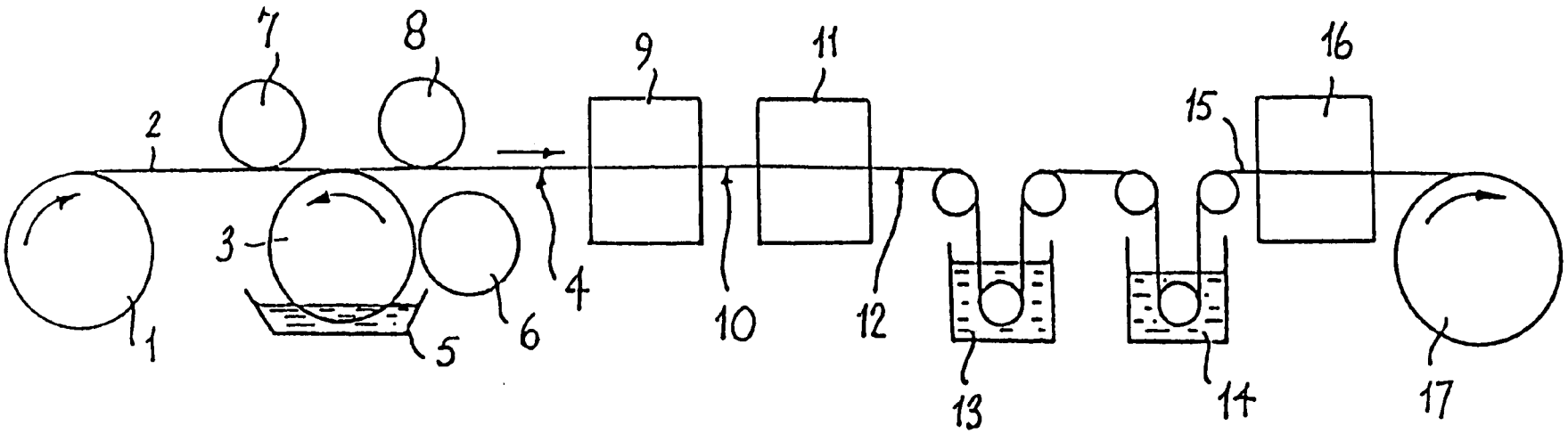
1
2
3
4
5
6
7
8
9
10
11
12
13
14
15
16
17

PROCESS FOR PRODUCING A COLORED POLYESTER FILM

CROSS-REFERENCE TO OTHER APPLICATIONS

This is a continuation of U.S. patent application Ser. No. 08/960,731, filed Oct. 29, 1997 (now abandoned), which is a continuation of U.S. patent application Ser. No. 08/801,031, filed Feb. 19, 1997 (now abandoned), which is a continuation of U.S. patent application Ser. No. 08/643,063, filed Apr. 30, 1996 (now abandoned), which is a continuation of U.S. patent application No. 08/443,688, filed May 18, 1995 (now abandoned), which is a continuation of U.S. patent application Ser. No. 08/090,887, filed Jul. 12, 1993 (now abandoned).

FIELD OF THE INVENTION

This invention relates to methods of colouring polyester film and to the coloured polyester films so produced.

BACKGROUND TO THE INVENTION

Coloured polyester films have numerous uses, for example as light filters, particularly in industrial applications, and in solar control applications such as window films for automobile, domestic and office windows. Polyester films are commonly coloured by dyeing with disperse dyes. A disperse dye may be defined generally as a substantially water-insoluble dye having substantivity for one or more hydrophobic polymers such as polyesters, for example poly(ethylene terephthalate).

One known method of dyeing a polyester film with a disperse dye relies upon swelling the film with an organic solvent. The dye is generally applied to the film in solution in the solvent, either at the same time as or subsequently to the swelling treatment. The former of these techniques is the one more commonly used. The dye diffuses into the swollen polyester film, which is then washed to remove the solvent and dried. The process of diffusion may be assisted by heating. This technique can be referred to as solvent dyeing. Solvent dyeing has the disadvantage that organic solvents capable of swelling polyester film and therefore suitable for the purpose are in general not environmentally friendly. The organic solvent may furthermore be difficult or expensive to remove from the film and to reclaim or to dispose of. The presence of residual solvent in the dyed film may affect subsequent processes such as metallisation.

Another known method of dyeing a polyester film utilises a suspension of disperse dye in a mixture of water and an organic solvent which swells the film. This method may be called solvent-assisted dyeing, and is otherwise similar to solvent dyeing.

Another known method of dyeing a polyester film with a disperse dye relies upon thermal diffusion of the dye into the film. The dye is brought into contact with the film which is then heated to cause migration of the dye into the film. The dye may be coated onto the film and the coated film dried and heated, or the dye may be provided on a separate sheet which is brought into contact with the film and the sheet and film are then heated. The former process may be referred to as theremofixation or thermosol fixation dyeing and the latter process as transfer printing. The heating step is generally carried out at or around the sublimation temperature of the dye. The process of transfer of dye into the film may be referred to as fixation.

DESCRIPTION OF THE PRIOR ART

U.S. Pat. No. 2,833,613 describes a process for dyeing polyester fibres in which the fibres are treated with disperse dyes in aqueous systems at about 100° C. using as carrier a mixture of dimethyl terephthalate and benzanilide, in a ratio of from 1:3 to 3:1 by weight.

U.S. Pat. No. 2,938,811 describes a process for improving the dyeability of a synthetic polyester textile material. The material is impregnated with a water-soluble high-boiling organic liquid, for example a polyhydroxy compound, preferably diethylene glycol, by heating at a temperature in excess of 120° C. or 175° C. The treated material is more rapidly dyed by disperse dyestuffs than untreated material is. The liquid may easily be removed or substantially completely removed from the dyed material by washing with water.

U.S. Pat. No. 3,034,847 describes a process for colouring polyethylene terephthalate film. The surface of the film is coated with a homogeneous composition comprising essentially a disperse type dye uniformly distributed in an organic liquid which uniformly (evenly) wets the surface of the film. The coated film is then heated to a temperature of 150–200° C. for a period of time sufficient to set the dye, i.e. to cause the dye to penetrate the surface of the film and hence become affixed in the film. The composition may contain 1–6% by weight dyestuff suspended or dissolved in the composition. The organic solvent must wet the surface of the film, and may for example be methyl ethyl ketone, benzyl alcohol, toluene, methyl isobutyl ketone, anisole, ethyl acetate, cyclohexanone, or a mixture of dimethyl acetamide and methyl ethyl ketone. The dyestuff may be applied to the film in the form of a uniform layer by any convenient coating or printing expedient, for example a gravure roll.

U.S. Pat. No. 3,058,798 describes a process for dyeing hydrophobic fibres, for example polyester fibres, in tow form. The tow is first padded with an aqueous dispersion of the disperse dye and then placed in a conventional raw stock dyeing machine, after which water is circulated through the padded tow at a temperature of 200–300° F. (93–149° C.) to fix the dye on the fibre. The aqueous dispersion contains 1–4% dye, 0.1% sodium alginate and 0.003% of a sodium aryl sulfonate wetting agent.

U.S. Pat. No. 3,512,913 describes a process for the continuous dyeing of polyethylene terephthalate film. A pre-treatment liquid containing dye-carrier is applied to the traveling web of the film and thereafter a hot aqueous dye-bath containing a disperse dye is applied to the web. Examples of suitable dye-carriers are phenol, ortho- and paraphenylphenol, diphenyl, chlorinated benzenes and diphenyls, methyl salicylate, benzoic acid and benzyl alcohol. Other examples include simple solvents such as the chlorinated hydrocarbons, for example methylene chloride, tetrachloroethane, chloroform or trichloroethylene. The dye-carrier is a material which has a noticeable swelling action on the film and consequently accelerates dyeing so that, for example, dyeing can satisfactorily be carried out at a temperature in the range 80–100° C. with a dyeing time of about 1–3 hours.

U.S. Pat. No. 3,958,934 describes a process in which an organic disperse dye is first applied by conventional means to a synthetic polymer, which may be a polyester film, by spraying, padding or printing, and the dye-treated polymer, optionally dried, is then passed through a fluorocarbon fluid at a temperature greater than the glass transition temperature of the polymer.

U.S. Pat. No. 4,065,259 describes a process for exhaust dyeing of disperse dyeable synthetic polymers, for example polyester, for example in the form of film, fibre or fabric, utilising a dye dispersion which comprises a disperse dye and a normally liquid fluorocarbon, for example poly (perfluoropropylene glycol).

C. J. Hawkyard, in a paper entitled 'The Release of Disperse Dyes from Thickener Films during Thermal Processes', Journal of the Society of Dyers and Colourists, Volume 97 (1981), pages 213–219, describes thermofixation dyeing of polyester films. A dye paste consists of a disperse dye (for example C. I. Disperse Red 60), 2.5–8% of a high molecular weight thickener (for example sodium alginate, sodium carboxymethyl starch, or hydroxylated guar gum), and water. The viscous dye paste is applied as a layer at least 24 micron thick to the surface of a polyester film using a stainless steel wire-wrapped rod. The layer is then dried, and the film heated to 200° C. to cause diffusion of the disperse dye from the dye paste into the film. The highest degree of fixation (that is, the proportion of the dye which diffuses from the layer of paste into the film) is obtained when a heterogeneous dye paste is used, for example by using sodium carboxymethyl starch as thickener or by emulsifying a low boiling point hydrocarbon, for example white spirit, into the dye paste.

SUMMARY OF THE INVENTION

The invention provides a process for producing a coloured polyester film including the steps of:

(1) providing a dye mixture which has a viscosity of no more than 500 centipoise at ambient temperature and which is a suspension of at least one disperse dyestuff in a solution of a thickener in water;

(2) coating said dye mixture onto a polyester film to form a layer; and (3) heating said film to cause said dyestuff to migrate from said layer into said film.

The polyester film is commonly poly(ethylene terephthalate), although other polyesters including polycarbonates may be used. The thickness of the film may be 5 to 250 micron, more often 10 to 50 micron, for example 12.5 or 25 micron. The film is preferably a biaxially oriented film. Uncoloured films of this type are readily available commercially.

The disperse dyestuff may in general be any disperse dyestuff having substantivity for polyester. Many such dyestuffs are available commercially. The dye mixture may contain a minimum of 0.1%, preferably 0.5%, more preferably 2%, by weight of the dyestuff on a dry weight basis. The dye mixture may contain a maximum of 20%, preferably 15%, more preferably 10%, by weight of dyestuff on a dry weight basis. The dye mixture may contain one or several dyestuffs. For example, known mixtures contain blue, red and yellow dyestuffs in suitably chosen proportions and may be called trichromatic mixtures. Such mixtures can be used to provide dyed films, for example solar control films of a grey or bronze colour. They can also be used to provide light-filter films having controlled light-absorbence properties over a wide range of wavelengths. The dyestuff or dyestuffs may absorb light of ultraviolet, visible or infrared wavelengths. The mixture may contain an ultraviolet absorber, particularly for use in solar control applications, for example a compound of the benzotriazole class which is capable of migration into the film in the heating step.

Disperse dyestuffs are commonly classified as type A (having a molecular weight around 250), B, C or D (having a molecular weight around 450). The vapour pressure of type A dyes increases the most rapidly as the temperature is raised and consequently fixation occurs more rapidly and at lower temperatures with type A dyes than with the other types. The vapour pressure of type D dyes increases the least rapidly with temperature.

The thickener is a water-soluble polymer. Preferred thickeners include sodium carboxymethylcellulose poly(vinyl alcohol) and sodium alginate. Other thickeners include water-soluble cellulose ethers, for example methyl cellulose, ethyl cellulose or hydroxyethyl cellulose. The thickener has a low molecular weight and accordingly a low solution viscosity in water. Preferred thickeners may exhibit a viscosity of 2 to 100 centipoise, more preferably 5 to 50 centipoise, measured on a 1% by weight solution of the thickener in water at ambient temperature. The dye mixture may contain a minimum of 0.1% by weight of the thickener, preferably 0.2%, more preferably 0.5%. The dye mixture may contain a maximum of 10% by weight of the thickener, preferably 5%, more preferably 2%. It is an advantage of the invention that low concentrations and amounts of thickener can be used, since the thickener can be washed off the film and discarded after use. The thickener is preferably biodegradable.

The dye mixture preferably has a viscosity at ambient temperature of less than 200 centipoise, more preferably less than 100 centipoise, further preferably less than 50 centipoise. The viscosity of the dye mixture is preferably at least 2 centipoise, more preferably at least 5 centipoise. A preferred range for the viscosity of the dye mixture is 5 to 50 centipoise. The viscosity of the dye mixture is measured under low shear conditions, for example in an Ostwald viscometer, Brookfield viscometer or Zahn cup. Dye pastes conventionally used in gravure printing commonly have viscosities in the range 2000–5000 centipoise. It was surprising to find that dye mixtures exhibiting low and very low viscosities could successfully be used according to the method of the invention to coat a uniform layer of dyestuff from an aqueous suspension onto a polyester film, which is hydrophobic. It was further remarkable to find that better quality film in terms of uniformity of colouration and freedom from streaks was obtained when a low viscosity dye paste having a viscosity below 500 centipoise according to the invention was used to coat the film than when a dye paste having a viscosity in excess of 1000 centipoise was used. This improvement was often more noticeable when red and blue dyestuffs were used than when yellow dyestuffs were used.

The solids in the dye mixture comprise the disperse dyestuff and the thickener. The minimum total solids content of the dye mixture by weight is preferably 0.1%, more preferably 0.2%, further preferably 2% or 5%. The maximum total solids content of the dye mixture by weight may be up to about 25% and is preferably 20%, more preferably 15%, further preferably 10%.

The dye mixture may optionally additionally comprise an organic liquid which is at least partially miscible with water, and which is miscible with water in the proportion used. The organic liquid may for example be an alcohol, for example ethanol or isopropanol, a ketone, for example acetone or methyl ethyl ketone, or an ester, for example ethyl acetate. Such liquids swell polyester little if at all at ambient temperature. The liquid preferably has a boiling point in the range 50 to 150° C., more preferably 70 to 120° C. It is thought that such a liquid may act as a wetting agent to improve the evenness of coating. The dye mixture may contain 5 to 50% by weight of the organic liquid, more preferably 5 to 40%, further preferably 10 to 25%.

The dye mixture may be made using a disperse dyestuff in powder or liquid form. Liquid disperse dyestuffs are commercially available and comprise a suspension of a disperse dyestuff in an aqueous solution, often also containing a water-miscible organic liquid such as ethylene glycol or propylene glycol. Such liquid disperse dyestuffs commonly contain around 20–50% by weight, for example about 40% by weight, of the dyestuff, and are viscous pastes which commonly have a viscosity around 2000–5000 centipoise. Some disperse dyestuffs are only available commercially in liquid form. Liquid disperse dyestuffs may be preferred for convenience in the practice of the invention.

Preparation of a conventional dye paste having a viscosity of 2000 centipoise or above from disperse dyestuff in powder form may require the use of special mixing apparatus or techniques in order to obtain a homogeneous blend. It is an advantage of the present invention that dye mixtures for use in the invention may readily be prepared from disperse dyestuffs in powder form because the low-viscosity dye mixture used in the invention is easily mixed to form a homogeneous blend.

The dye mixture may in general be made by simple mixture of the dyestuff (in liquid or powder form) and a solution of the thickener in water and the optional organic solvent. The mixture is preferably filtered, for example through a fibre or steel woven gauze, to remove any oversize particles. The dye mixture preferably contains essentially no particles larger than 50 micron in size, more preferably 20 micron, further preferably 10 micron. Average particle size is preferably less than about 1 micron.

The dye mixture is preferably coated onto the film by use of a gravure printing roll in a gravure printing process, more preferably by reverse gravure printing. In one embodiment of the invention, the film passes between the reverse gravure roll and an impression roller. In this embodiment, the speeds of the film and of the gravure roll are preferably the same or similar. The speed of the film and the surface speed of the roll may be for example be in the range 10 to 500 feet/min, preferably 100 to 200 feet/min, each measured with respect to the outside world. In another embodiment of the invention, the film passes between the reverse gravure roll and two yoke rollers which serve to hold the film in light contact with the gravure roll. In this embodiment, the surface speed of the gravure roll is preferably higher than the speed of the film, generally in the range 1.25:1 to 2.5:1, preferably 1.5:1 to 2.0:1. The sped of the film may be in the range 10 to 500 feet/min, preferably 100 to 200 feet/min. This technique can be used to obtain excellent quality film with very few defects. Other coating techniques, for example offset printing, slot-jet (slot-die) coating or Mayer rods (metering rods), may also be used. The dye mixture may be coated onto the film at ambient temperature. It was unexpected to find that an aqueous suspension of dyestuff exhibiting a low viscosity could successfully be coated onto a hydrophobic polyester film in a gravure printing process to form a uniform coating. The coated wet layer is typically a few micron thick, for example 1 to 10 micron thick. It has surprisingly been found that more perfect films having fewer defects can be prepared by the method of the invention than by gravure printing according to the prior art using a high-viscosity dye paste.

The layer is usually dried before the heating and migration step. The wet layer may be dried at ambient or elevated temperature, for example on steam-heated rollers or in an electrically-heated oven at around 80–120° C. or by exposure to infrared radiation. The dry coating weight of the film, that is, the weight per unit area of the dried layer, is preferably in the range 0.1 to 2.0 grams per square meter. Alternatively, the layer may be dried during the heating step, as a preliminary part of that step. The time between coating and drying is chosen to allow sufficient time for the wet layer to level but is not so long that deterioration or contamination of the wet layer occurs.

The heating step may be carried out for example at 160° C. for 60 seconds or 180° C. for 30 seconds, although higher or lower temperatures and other times can also be used. The heating step is carried out at a temperature below that at which degradation of the film or the dyestuff would occur. For example, temperatures up to 190° C. or 200° C. may be used. It has been found that higher temperatures may produce undesirable banding in the coloured film. The time of the heating step is preferably in the range 5 to 60 seconds. The heating step can often be carried out at temperatures lower than conventionally used for transfer printing of disperse dyes, which printing is often carried out at 200–210° C. It is generally thought that disperse dyes migrate during transfer by sublimation. It was therefore surprising to find that a wide variety of disperse dyes could be caused to migrate into the film at temperatures at or below the sublimation temperature of the dyestuff. The ability to use relatively low fixation temperatures is an advantage of the invention. Polyester film may be damaged, for example by shrinking, and dyestuffs may be chemically degraded by excessive heating. The most appropriate heating time at any particular temperature can be selected on the basis of experiments in which the increase in colouration of samples of film with time at that temperature is monitored. Different dyestuffs may migrate at different rates. It is an advantage of the invention as compared with transfer printing that diffusion and fixation takes place as contact diffusion through a zero air-gap. The heating step is preferably carried out in a hot air oven.

The layer becomes exhausted of dyestuff during the heating step as dyestuff migrates into the film. After the heating step, the exhausted layer comprises the thickener and any residual dyestuff which has not migrated into the film. This exhausted layer is preferably removed from the film by washing, preferably with water. The film may be washed by passage through hot or cold water, preferably hot water. The film may be passed through an agitated bath of water. The film may alternatively or additionally be sprayed with water. Alternatively, the film may be washed by passage through cold or warm water white being subjected to ultrasonic vibrations. It may be preferred to precede the water wash by a washing treatment with a water-miscible organic solvent, for example a ketone solvent such as acetone or an amide solvent such as N-methyl-2-pyrrolidinone. Use of a water-miscible solvent may for example be preferred when the film contains a water-insoluble ultraviolet absorber of the benzophenone class. The development of colouration after different heating times as mentioned hereinabove may also be monitored by spectroscopic or other measurement of the amount of dye washed off the film in this step. A further advantage of the present invention in comparison with solvent dyeing and solvent-assisted dyeing is that, because no swelling agent is required, and because such swelling agents are generally solvents for disperse dyestuffs, as a consequence less dye is washed out of the film in the washing step. This invention therefore provides more efficient use of dyestuff and less contaminated washing liquors than conventional processes.

It is important in the commercial production of coloured polyester films to ensure that the coloured film is to the highest degree possible free from colour defects such as streaks, marks and unlevelness of colour. In one method of performing the invention, an excess of dyestuff over that required for the desired degree of colouration is coated onto the film. The excess dyestuff may be removed from the film after the heating step together with the thickener by washing. The presence of excess dyestuff during the heating step assists in providing a level of colouration which is as uniform as possible over the area of the film. It is generally preferable, however, to exercise sufficient control over the process of the invention so that the amount of excess is as low as possible. This means that the washing liquor contains the minimum amount of dyestuff to be discarded or recovered. If the coating is applied to the film in a highly uniform manner, then the heating step may be performed under conditions in which essentially all the dyestuff, for example 95% or 98% or more of the dyestuff, migrates from the layer into the film. Under such conditions, the washing liquor may be very lightly coloured or nearly colourless.

Conventional solvent dyeing and solvent-assisted dyeing processes are often carried out semi-batchwise. For example, in solvent-assisted dyeing a dye bath is made using dyestuff, water and swelling agent. Film is unwound from a roll, passed through the bath, heated to fix the dye, washed, dried, and collected on another roll. More dye bath components may be added from time to time during this process. It is difficult in such a process to maintain the composition of the dye bath as accurately as could be desired. The dye bath becomes exhausted of its components as the roll of film is unwound and passed through it. This leads to non-uniformity of dyeing along the roll of film. Continuous analysis and correction of dye bath composition requires additional specialist apparatus. This disadvantage can be avoided by the use of the present invention, because the dye mixture can be coated onto the film from a constant composition reservoir. Continuous analysis and correction is not required. The colour of film dyed according to the method of the invention is highly uniform along the length of the film.

It is an advantage of the invention that intensely coloured films can be obtained by its use. It may be difficult to obtain a desired high degree of colouration with some commercial disperse dyes by the conventional techniques of solvent dyeing and solvent-assisted dyeing without the generation of colour defects such as spotting and streaking. Coloured polyester films exhibiting an optical transmission of less than 20%, less than 10%, less than 5% or around 2 % at an absorption maximum of such a dyestuff component can be readily prepared. Coloured polyester films may be readily dyed conventionally with the same dyestuffs to obtain an optical transmission of 20%, and with more difficulty of 5%, but it may be necessary to laminate two or more films together to obtain low values of optical transmission.

Intensely coloured films may be obtained by applying the process of the invention more than once to a film.

It is known that commercial liquid disperse dyes often contain a swelling agent, for example 10–25% or around 20% ethylene glycol or propylene glycol. Nevertheless, the amount of swelling agent present in the dye mixture and in the film, even when such commercial liquid disperse dyes are used, is very much less when the method of the present invention is used than in prior art solvent dyeing and solvent-assisted dyeing processes, perhaps by a factor of 20 or more.

It is known that polyester film containing swelling agent tends to shrink, perhaps by up to 5 or 6%, during heating. The film is generally held under tension during conventional solvent dyeing and solvent-assisted dyeing processes. The absence or very low level of swelling agent in the dye mixture used in the method of the invention is an advantage in the heating step. It has been found that films treated according to the process of the invention generally shrink by no more than 0.5 to 2% during the heating step, for example around 1% at 180° C. or around 2% at 200° C.

It is known to be difficult in the prior art processes of solvent dyeing and solvent-assisted dyeing to remove all the swelling agent after dyeing. The presence of residual swelling agent alters the properties of the dyed film. Many of the known swelling agents have undesirable toxicological or environmental properties. It is an advantage of the present invention that no swelling agent need be present in the dye mixture. Dye mixtures which are essentially free of any swelling agent may be preferred in the method of the present invention.

Dyes polyester film is often metallised, for example for use in solar control applications. It is sometimes found that the metal does not adhere well or uniformly to the surface of the film during the metallisation process. This defect has been attributed to the presence of residual swelling agent in the film. This disadvantage can be overcome by the process of the present invention, since no swelling agent is required. Even if the dye mixture contains a low level of swelling agent, for example when a liquid disperse dye containing a swelling agent as mentioned above is used, much less swelling agent is present than in prior art solvent dyeing or solvent-assisted dyeing processes.

The disperse dyestuff generally penetrates only a relatively small distance into the film in the practice of the process of the invention. It penetrates into the surface region adjacent to and underlying the coated surface and is substantially all present in this surface region. Dye distribution through a film may be studied for example by infrared spectroscopy of thin sections of film cut with a microtome. For example, in a dyed film 25 micron thick it may be observed that 90% of the dyestuff is to be found in a surface region amounting to about 10 or 20% of the thickness and that the remaining 10% of the dyestuff is to be found in the remaining 90 or 90% or so of the thickness. If the degree of leveling through the film is greater, it may be observed that 90% of the dyestuff is to be found in a surface region amounting to about 50% of the film thickness. This effect may be advantageous if one or more of the dyes used is sensitive to light, in particular ultraviolet light. At least the sensitive dye may be printed on the side of the film intended in use to be remote from the source of light, for example sunlight in solar control applications such as automobile window film. The polyester provides some protection to the sensitive dye, which is an advantage of the invention. The film may contain a substance which absorbs the harmful wavelengths of light, for example an ultraviolet absorber. The ultraviolet absorber may be incorporated into the film in a number of ways. For example, it may be incorporated into the film during its manufacture. Alternatively, the film may be dyed with the ultraviolet absorber, preferably according to the method of the invention, further preferably on the side of the film intended in use to be nearer the source of light. The amount of harmful light reaching the sensitive dye is thereby reduced to a minimum. This small depth of dye penetration provided by the present invention offers an advantage over films which are dyed more uniformly through their thickness, for example self-coloured films produced by incorporating a dye or pigment in the film during manufacture or films dyed with the assistance of a swelling agent. Ultraviolet absorbers incorporated in such known more uniformly dyed films do not protect the sensitive dye in the surface of the film nearer to and exposed to the source of harmful radiation.

The invention accordingly provides in another aspect a coloured polyester film having a first and a second surface, said film being dyed with at least two disperse dyestuffs, at least a first dyestuff of said dyestuffs being substantially all present in a surface region adjacent said first surface, and at least a second dyestuff of said dyestuffs being substantially all present in a surface region adjacent said second surface. In a preferred embodiment, at least one of said dyestuffs is an ultraviolet absorber. In a further preferred embodiment, the first of said dyestuffs is an ultraviolet absorber and the second of said dyestuffs comprises one or more coloured disperse dyestuffs.

An ultraviolet absorber may alternatively be incorporated in a polyester film by extruding a polyester dope containing the absorber to form a film or by conventional dyeing processes. The absorber is substantially uniformly dispersed through such a film. The invention further provides a coloured polyester film containing an ultraviolet absorber substantially uniformly dispersed therethrough, said film being dyed with at least one disperse dyestuff, said at least one dyestuff being substantially all present in a surface region of said film.

The invention provides in a further aspect a polyester film having a first and a second surface, said film being dyed with at least one disperse dyestuff, said at least one disperse dyestuff being substantially all present in a surface region adjacent said first surface, and said film being metallised on said first or said second surface. Preferably the second surface is metallised; that is, the opposite sides of the film are dyed and metallised. It has been observed that metallisation of the dyed surface may be technically less satisfactory than metallisation of the undyed surface. If the first surface of the film is dyed with one or more coloured dyestuffs and the second surface is dyed with an ultraviolet absorber as hereinbefore described, it may however be preferred to metallise the first surface of the film.

The invention further provides a process for producing a coloured polyester film, said film having a first and a second surface, including the steps of:

(1) providing a dye mixture which has a viscosity of no more than 500 centipoise at ambient temperature and which is a suspension of at least one disperse dyestuff in a solution of a thickener in water;

(2) coating said dye mixture onto a polyester film to form a layer on said first surface;

(3) heating said film to cause said dyestuff to migrate from said layer into said film; and (4) metallising said first or said second surface.

Preferably, the second (undyed) surface is metallised. If the first surface of the film is dyed with one or more coloured dyestuffs and the second surface id dyed with an ultraviolet absorber as hereinbefore described, it may however be preferred to metallise the first surface of the film.

Either or both sides of a film may be dyed by the method of the invention. It may generally be preferred for simplicity to dye only one side of the film. It may be preferred to dye the side of the film intended to be exposed to a source of harmful radiation as hereinbefore mentioned with an ultraviolet absorber and to dye the other side of the film with coloured dyestuffs.

Coloured polyester film prepared according to the method of the invention may be laminated to another film, for example a metallised polyester film. The invention accordingly further provides a film laminate, said laminate containing at least one polyester film having a first and a second surface, said film being dyed with at least one disperse dyestuff, said dyestuff being substantially all present in a surface region adjacent said first surface, said film being laminated to a metallised polyester film. In a preferred form of construction, the first (dyed) or preferably the second (undyed) surface of the coloured film is laminated to the unmetallised surface of the metallised film.

Coloured polyester film prepared according to the method of the invention may be coated in known manner, for example with a scratch-resistant coating or hardcoat.

Coloured polyester film prepared according to the method of the invention may be adhered to glass and suchlike materials, for example in the form of automobile windows or of flat glass such as is used in domestic and office windows. The invention accordingly further provides a window having a polyester film adhered thereto, said film having a first and a second surface, said film being dyed with at least one disperse dyestuff, said dyestuff being substantially all present in a surface region adjacent said first surface. The film may be adhered to the outside or preferably the inside surface of the glass. The outside surface of the glass is the side exposed to the outside world and in particular to sunlight. If the film is dyed on one surface only, preferably the undyed (second) surface of the film is adhered to the glass. In a particularly preferred form of construction, the undyed (second) surface of the film is adhered to the inside surface of the glass. This form of construction is particularly advantageous in that it provides maximum resistance to fading of the colour

BRIEF DESCRIPTION OF THE DRAWING

The invention will now be illustrated with reference to the accompanying FIGURE, which is a schematic diagram of a process for producing a coloured polyester film according to the invention.

DESCRIPTION OF PREFERRED EMBODIMENTS

Referring to the FIGURE, a roll of polyester film 1 is unwound and the running film indicated generally at 2 is fed over a reverse gravure printing roll 3 which serves to coat it with a dye mixture, so yielding a film coated with a wet layer of the dye mixture as indicated generally at 4. The dye mixture is a suspension having a viscosity of no more than 500 centipoise at ambient temperature of at least one disperse dyestuff in a solution of a thickener in water as hereinbefore described. The dye mixture is contained in pan 5 through which gravure roll 3 rotates. Metering roll 6 is in near contact with gravure roll 3 and serves to ensure that gravure roll 3 is coated with a thin uniform layer of dye mixture when gravure roll 3 contacts the film. Gravure roll 3 rotates in the opposite sense to the direction of travel of the film as indicated by the curved arrow. The film is held in grazing contact with gravure roll 3 by means of the pair of yoke rollers 7, 8 to ensure transference of the dye mixture from gravure roll 3 to the film. It will readily be understood that other forms and configurations of gravure printing equipment known in the art may be used, for example involving more complex film paths or the use of a doctor blade instead of a metering roll to provide the thin uniform layer of dye mixture on the gravure roll. The film is then fed through oven 9 maintained at a temperature of about 80–120° C. to dry the layer of dye mixture on the film. The path of the film through oven 9 may for example be about 15 feet long, this length being chosen to suit the conditions of operation of the process. The film coated with a dry layer of dye mixture indicated generally at 10 is then passed through oven 11 maintained at a temperature of for example about 160–180° C. in order to cause the dyestuff to migrate from the dry layer into the film. The path of the film through oven 11 may for example be about 15 feet long, this length being chosen to suit the conditions of operation of the process. The dyed film coated with an exhausted layer of thickener indicated generally at 12 is passed through wash bath 13 containing an organic solvent such as acetone or N-methyl-2-pyrrolidinone and then through wash bath 14 containing water. The washed coloured film indicated generally at 15 is then passed through oven 16 to dry the film, and the coloured film taken up on roll 17 at the conclusion of the process.

The invention is illustrated by the following Examples, in which all parts, percentages and proportions are by weight unless otherwise specified.

EXAMPLE 1

A stock solution of thickener was made by dissolving 2 parts sodium carboxymethyl cellulose (SCMC) in 98 parts water. The SCMC used as Courlose F8 (Trade Mark) available from Courtaulds plc which is specified as exhibiting a viscosity of 6–9 centipoise as a 1% aqueous solution.

Another stock solution of thickener was made by dissolving 4 parts poly(vinyl alcohol) (PVA) in 96 parts water. The PVA used was Airvol 523S (Trade Mark) available from Air Products and Chemicals Inc., Allentown, Pa. which is specified as exhibiting a viscosity of 5.2–6.2 centipoise as a 4% solution in water.

Dye mixtures were made by mixing 1 part of various liquid disperse dyestuffs with 5 parts of one of the stock solutions. In some cases, isopropyl alcohol (IPA) was added to the resulting mixture. The dye mixtures exhibited viscosity in the range 17.5–23 sec measured using a Number 2 Zahn cup. Such viscosities are much lower than 500 centipoise.

The dye mixtures were coated onto 24 micron thick biaxially oriented polyester film (supplied by Hoechst Diafoil under the Trade Mark Hostaphan 5211) using a gravure printing machine supplied by Inta Roto, Richmond, Va. The gravure cylinder used was a standard cylinder of 6 inches diameter being either a 75QCH or a 140QCH (quadrical with channeling) cylinder. QCH is a Trade Mark of Consolidated Engravers Corporation, 311 East 12th Street, Charlotte, N.C. The gravure cylinder was driven at the same speed as the film web but in the opposite direction.

The coated films were predried at 100° C. in the air oven of the abovementioned gravure printing machine. The dry coating weight (DCW) of samples of the film was measured gravimetrically. The films were then passed through two five foot long ovens heated to 185° C. at 24 ft/min to effect thermosol fixation of the dyestuff from the coating layer into the polyester film. They were substantially rinsed through a first bath of N-methyl-2-pyrrolidinone and a second bath of cold water and then dried. The wash liquors contained a small amount of unfixed dye.

The quality of the dyed film (uniformity, in particular freedom from streakiness) was assessed visually by comparison of different samples of film and is quoted as a Quality Index on a scale of 1 (very poor) to 10 (flawless).

The experimental conditions used and results obtained are shown in Tables 1 and 2:

TABLE 1

| Trial No. | Cylinder Type | Stock | Dye | IPA % | Web Speed feet/min | DCW gm-2 | Quality Index |
|---|---|---|---|---|---|---|---|
| 29 | 140 QCH | 2.0% SCMC | B | — | 41 | 0.41 | 4 |
| 30 | 140 QCH | 4.0% PVA | B | — | 40 | 0.53 | 3 |
| 31 | 140 QCH | 4.0% PVA | B | — | 60 | 0.52 | 5 |
| 32 | 140 QCH | 4.0% PVA | B | — | 80 | 0.52 | 6 |
| 33 | 140 QCH | 4.0% PVA | B | — | 100 | 0.51 | 7 |
| 34 | 75 QCH | 4.0% PVA | B | — | 40 | 0.99 | 4 |
| 35 | 75 QCH | 4.0% PVA | B | — | 100 | 1.01 | 6 |
| 36 | 75 QCH | 4.0% PVA | B | 10 | 100 | 0.96 | 7 |
| 37 | 75 QCH | 4.0% PVA | B | 10 | 40 | 0.96 | 6 |
| 38 | 75 QCH | 2.0% SCMC | B | — | 40 | 0.70 | 6 |
| 39 | 75 QCH | 2.0% SCMC | B | — | 100 | 0.76 | 6 |
| 40 | 75 QCH | 2.0% SCMC | B | 10 | 100 | 0.61 | 6 |
| 41 | 75 QCH | 2.0% SCMC | B | 10 | 40 | 0.64 | 6 |
| 42 | 140 QCH | 2.0% SCMC | B | — | 100 | 0.37 | 6 |
| 43 | 140 QCH | 2.0% SCMC | B | 10 | 100 | 0.32 | 7 |
| 44 | 140 QCH | 2.0% SCMC | B | 10 | 40 | 0.33 | 5 |
| 45 | 140 QCH | 2.0% SCMC | B | 20 | 100 | 0.30 | 8 |
| 46 | 140 QCH | 2.0% SCMC | B | 20 | 40 | 0.30 | 5 |
| 47 | 140 QCH | 2.0% SCMC | B | 30 | 100 | 0.28 | 9 |
| 48 | 140 QCH | 2.0% SCMC | B | 30 | 150 | 0.21 | 9 |
| 49 | 140 QCH | 2.0% SCMC | B | 30 | 40 | 0.28 | 8 |
| 50 | 140 QCH | 2.0% SCMC | 12% R | 30 | 150 | 0.31 | 9 |
| 51 | 140 QCH | 2.0% SCMC | 8% R | 30 | 150 | 0.21 | 9 |
| 52 | 140 QCH | 2.0% SCMC | Y | 30 | 150 | 0.23 | 10 |
| 53 | 140 QCH | 2.0% SCMC | BRY | 30 | 150 | 0.22 | 9 |

TABLE 2

| | |
|---|---|
| Trial 29 | Medium to fine streaks |
| Trial 30 | Medium streaks |
| Trial 31 | Fine streaks |
| Trial 32 | Very fine streaks |
| Trial 33 | Very fine streaks. Best of 29–33 |
| Trial 34 | Medium to fine streaks. Similar to 29 with twice the depth |
| Trial 35 | Very fine streaks. Similar to 32 with twice the depth |
| Trial 36 | Very fine streaks. Similar to 33 with twice the depth |
| Trial 37 | Very fine streaks. Similar to 35. Worse than 36 |
| Trial 38 | Very fine streaks. Similar to 35 |
| Trial 39 | Very fine streaks. Similar to 38 |
| Trial 40 | Very fine streaks. Worse than 39 |
| Trial 41 | More defined streaks than 40, but less unevenness |
| Trial 42 | Very fine streaks. Similar to 43. Worse than 33 |
| Trial 43 | Very fine streaks. Better than 33. Best of 29–43 |
| Trial 44 | Fine streaks. Similar to 31 |
| Trial 45 | Ultra fine streaks. Best of 29–45 |
| Trial 46 | Fine streaks. Similar to 44 |
| Trial 47 | Ultra fine streaks. Best of 29–47 |

TABLE 2-continued

| | |
|---|---|
| Trial 48 | Ultra fine streaks. Small improvement over 47. Best of 29–48 |
| Trial 49 | Ultra fine streaks. Similar to 45 |
| Trial 50 | Ultra fine streaks. Slightly worse than 48 |
| Trial 51 | Ultra fine streaks. Better than 50. Similar to 48. Slight chatter bars |
| Trial 52 | Appears perfect |
| Trial 53 | Ultra fine streaks. Similar to 50 |

The dyestuffs referred to as B, R and Y in Table 1 were C.I. Disperse Blue 60, C.I. Disperse Red 60 and C.I. Disperse Yellow 88 respectively. All these dyestuffs were obtained from Ciba-Geigy in the form of liquid dyestuffs containing approximately 40% solids and approximately 20% 1,2-propylene glycol. The BRY mixture used in Trial 53 was designed to produce a charcoal-coloured film. The dye mixtures used in Trials 50 and 51 contained 88 parts stock to 12 parts liquid disperse dyestuff and 92 parts stock to 8 parts liquid disperse dyestuff respectively. IPA addition is recorded in Table 1 as parts IPA per 100 parts dyestuff/stock mixture.

EXAMPLE 2

Example 1 was repeated, with the following differences. The stock solution of SCMC was made by dissolving 1 part Courlose F8 in 99 parts water. The stock solution of PVA was made by dissolving 2 parts Airvol 523S in 98 parts water. The dye mixtures used exhibited a viscosity of around 14 to 17 seconds measured in a Number 2 Zahn cup, well below 500 centipoise. A 110QCH gravure cylinder was used in some experiments. The gravure cylinder was driven in the opposite direction to the film web, but not necessarily at the same speed. The coated films were generally predried in the air oven at 93° C., although in some cases UV lamps were used. It was noted on occasion that uneven air flow in the oven or uneven power output from the lamps over the width of the film led to undesirable banding lines in the dried film. This effect was less in those trials where the dye mixture contained IPA. Banding was also more apparent if the doctor blade on the gravure roll was damaged or mounted incorrectly. Banding could be avoided by proper control of the conditions. Dye fixation was carried out by passage through two ovens five foot long at an oven temperature of 200° C. at 12 ft/min. Film temperature was measured at 130° C. using an infrared sensor. These films were washed by passage through a single bath of cold water containing a small amount of a non-silicone antifoaming agent. The wash liquor contained a small amount of unfixed dye. The experimental conditions used and results obtained are shown in Tables 3 and 4.

TABLE 3

| Trial No. | Cylinder Type | Stock | Dye | IPA % | Web Speed feet/min | Cylinder Speed feet/min | DCW gm-2 | Quality Index |
|---|---|---|---|---|---|---|---|---|
| 63 | 140 QCH | 1% SCMC | B | — | 40 | 40 | 0.33 | 5 |
| 64 | — | — | — | — | 100 | 100 | 0.31 | 5 |
| 65 | — | — | — | — | 40 | 10 | | 4 |
| 66 | — | — | — | — | 40 | 20 | | 5 |
| 67 | — | — | — | — | 40 | 50 | | 5 |
| 68 | — | — | — | — | 40 | 70 | | 4 |
| 69 | — | — | — | — | 40 | 20 | | 5 |
| 70 | — | — | — | — | 40 | 40 | | 4 |
| 71 | — | — | — | — | 100 | 80 | | 4 |
| 75 | — | — | — | — | 40 | 40 | | 4 |
| 76 | — | — | — | — | 40 | 50 | | 3 |
| 77 | — | 2% PVA | — | — | 40 | 40 | 0.46 | 4 |
| 78 | — | — | — | — | 40 | 40 | | 4 |
| 79 | — | — | — | — | 100 | 100 | | 3 |
| 80 | — | — | — | s10 | 40 | 40 | 0.39 | 5 |
| 81 | — | — | — | s10 | 40 | 50 | | 6 |
| 82 | — | — | — | s10 | 100 | 100 | | 6 |
| 83 | — | — | — | s20 | 40 | 40 | 0.36 | 7 |
| 84 | — | — | — | s20 | 100 | 100 | | 7 |
| 85 | — | — | — | s20 | 40 | 50 | | 7 |
| 86 | — | — | — | s30 | 40 | 40 | 0.33 | 8 |
| 87 | — | — | — | s30 | 40 | 40 | 0.33 | 8 |
| 88 | — | — | — | s30 | 100 | 100 | 0.33 | 7 |
| 89 | — | — | — | 30 | 40 | 40 | 0.24 | 9 |
| 90 | — | — | — | 30 | 40 | 45 | | 9 |
| 91 | — | 1% SCMC | — | 20 | 40 | 40 | 0.27 | 9 |
| 92 | — | — | — | 20 | 40 | 45 | | 9 |
| 93 | — | — | — | 30 | 40 | 40 | 0.18 | 9 |
| 94 | — | — | R | 20 | 40 | 40 | 0.29 | 10 |
| 95 | — | — | V | 20 | 40 | 40 | | 9 |
| 96 | — | — | 8% V | 20 | 40 | 40 | | 9 |
| 97 | — | — | BRY | 20 | 40 | 40 | | 8 |
| 98 | — | — | — | 20 | 40 | 40 | | 9 |
| 99 | — | — | — | 20 | 40 | 100 | | 8 |
| 100 | — | — | — | 20 | 40 | 150 | | 7 |
| 101 | — | — | — | 20 | 40 | 40 | | 9 |
| 102 | — | — | — | 20 | 40 | 40 | | 9 |
| 104 | 110 QCH | — | R | 20 | 40 | 40 | 0.47 | 9 |
| 105 | — | — | — | 20 | 40 | 50 | | 9 |
| 107 | — | — | — | 30 | 40 | 40 | 0.41 | 10 |
| 108 | — | — | BRY | 20 | 40 | 40 | | 8 |
| 109 | 75 QCH | — | — | 20 | 40 | 40 | | 8 |

TABLE 4

| | |
|---|---|
| Trial 63 | Comparable to trial number 29 |
| Trial 64 | Worse than 63 but comparable to 42 |
| Trial 65 | Worse than 64 |
| Trial 66 | Similar to 64 |
| Trial 67 | Similar to 64, some horizontal chatter lines |
| Trial 68 | Worse than 67, more horizontal chatter lines |
| Trial 69 | Same as 66 |
| Trial 70 | Worse than 63 |
| Trial 71 | Similar to 70 |
| Trial 75 | Worse than 63 |
| Trial 76 | Worse than 75 |
| Trial 77 | Worse than 63 |
| Trial 78 | Worse than 77 |
| Trial 79 | Worse than 78 |
| Trial 80 | Better than 77 |
| Trial 81 | As 80 |
| Trial 82 | As 80 |
| Trial 83 | Better than 80 |
| Trial 84 | As 83 |
| Trial 85 | As 83 |
| Trial 86 | Better than 83 |
| Trial 87 | As 86 |
| Trial 88 | Worse than 86 |
| Trial 89 | Better than 87. Best so far |
| Trial 90 | Slightly worse than 89 |
| Trial 91 | Far superior to 63. Best so far |
| Trial 92 | As 91 |
| Trial 93 | No improvement over 91 |
| Trial 94 | Excellent quality, best so far. Slight evidence of doctor blade faults |
| Trial 95 | Excellent yield, worse quality than 94 |
| Trial 96 | As 95, but some dewetting |
| Trial 97 | Reasonable quality, but light and dark bands. Some streaks |
| Trial 98 | Better than 97, less streaks |
| Trial 99 | Worse than 97, more streaks |
| Trial 100 | Worse than 99, more streaks |
| Trial 101 | As 98, but less red |
| Trial 102 | Slight improvement on 101 |
| Trial 103 | As good as 94 |
| Trial 104 | Poorer quality than 94. More banding |
| Trial 105 | As 104 |
| Trial 107 | Significant improvement over 94 |
| Trial 108 | Similar to 97. Greater colour yield |
| Trial 109 | Greater colour yield than 108. Lots of dye spots. |

Dyes B and R were the same as those used in Example 1. The BRY mix used in some of the trials consisted of dyes B and R together with C.I. Disperse Yellow 54, and was designed to produce a film of a charcoal shade. Dye V was C.I. Disperse Violet 57. The dye mixture used in Trial No. 96 was made using 1 part liquid disperse dyestuff and 11 parts stock solution.

It was found that, contrary to expectations, increasing the cylinder speed relative to the web speed caused a decrease in coating quality. It was found that coating quality was generally better when the dye mixture contained IPA. It was also found that web and cylinder speeds of 100 ft/min and higher could be used more satisfactorily when the dye mixture contained IPA.

EXAMPLE 3

Coated film from Trial 94 was heated in an air oven at 200° C. at a speed of 12 ft/min (residence time 50 seconds). The treated film exhibited an optical transmission of 35%. Samples of the treated film were then coated and heated a second time under the same conditions. The opposite side of the film was treated in Trial 94A, and the same side of the film in Trial 94B. These twice-treated films exhibited optical transmissions of 25% and 24.5% respectively.

EXAMPLE 4

An earlier series of trials was carried out in similar fashion to Example 1. In some of these trials, the thickener used was a purified SCMC available from Courtaulds plc under the Trade Mark Courlose F75G. This is specified as having a viscosity of 60–90 centipoise measured on a 1% aqueous solution at 25° C. using an Ostwald viscometer. In others of these trials, the thickener used was a PVA available from Air Products and Chemicals Inc. under the Trade Mark Airvol 540. This is specified as having a viscosity of 45–55 centipoise measured on a 4% aqueous solution at 20° C. Films were coated using Mayer rods or reverse offset or reverse gravure techniques. Film speed was equal to roll speed. The other experimental conditions used and the results obtained are shown in Tables 5 and 6:

TABLE 5

| Trial No. | Rod/Cylinder Type | Set Up | Stock | Dye | IPA % | Web Speed feet/min | WCW gm-2 | DCW gm-2 | Viscosity No. 2 Zahn Cup Sec. | Quality Index |
|---|---|---|---|---|---|---|---|---|---|---|
| 1 | Rod 5 | Meyer Rod | 1.6% SCMC | B | — | 30 | 4.17 | 0.32 | — | 1 |
| 2 | Rod 10 | Meyer Rod | 1.6% SCMC | B | — | 30 | 11.30 | 0.86 | — | 1 |
| 3 | Rod 10 | Meyer Rod | 1.0% SCMC | B | — | 30 | 12.08 | 0.86 | 27.0 | 2 |
| 4 | Rod 10 | Meyer Rod | 3.0% PVA | B | — | 30 | 9.26 | 0.81 | 16.3 | 3 |
| 5 | 140 QCH | Reverse Offset | 3.0% PVA | B | — | 40 | 6.72 | 0.59 | 16.3 | 2 |
| 6 | 140 QCH | Reverse Offset | 1.0% SCMC | B | — | 40 | 5.37 | 0.38 | 27.0 | 2 |
| 7 | 140 QCH | Reverse Gavure | 1.0% SCMC | B | — | 50 | 6.49 | 0.46 | 27.0 | 3 |
| 8 | 35 QCH | Reverse Offset | 1.0% SCMC | B | — | 40 | 18.35 | 1.31 | 27.0 | 2 |
| 9 | 35 QCH | Reverse Offset | 3.0% PVA | B | — | 40 | 20.52 | 1.81 | 21.0 | 3 |
| 10 | 140 QCH | Reverse Gravure | 3.0% PVA | B | — | 40 | 7.62 | 0.67 | 21.0 | 3 |
| 11 | 140 QCH | Reverse Gravure | 3.0% PVA | B | 10 | 40 | 7.39 | 0.59 | 20.0 | 6 |
| 12 | 140 QCH | Reverse Gravure | 1.0% SCMC | B | 10 | 40 | 5.41 | 0.35 | 24.5 | 6 |
| 13 | 140 QCH | Reverse Gravure | 0.6% SCMC | B | — | 40 | 6.34 | 0.43 | 17.5 | 7 |
| 14 | 140 QCH | Reverse Gravure | 0.6% SCMC | B | 10 | 40 | 5.16 | 0.32 | 16.7 | 7 |
| 15 | 140 QCH | Reverse Gravure | 0.6% SCMC | Y | — | 40 | 6.60 | 0.43 | 17.3 | 8 |
| 16 | 140 QCH | Reverse Gravure | 0.6% SCMC | Y | 10 | 40 | 5.92 | 0.35 | 18.0 | 10 |
| 17 | 140 QCH | Reverse Gravure | 0.6% SCMC | R | 10 | 40 | 7.08 | 0.49 | 18.0 | 7 |
| 18 | 140 QCH | Reverse Gravure | 0.6% SCMC | BRY | 10 | 40 | — | — | 17.14 | 8 |

TABLE 6

| | |
|---|---|
| Trial 1 | Very streaky with evidence of gels and dye spots. |
| Trial 2 | Very streaky with evidence of gels and dye spots. |
| Trial 3 | Very streaky with evidence of gels and dye spots. |
| Trial 4 | Very streaky with evidence of gels. |
| Trial 5 | Very fine streaks. |
| Trial 6 | Very fine streaks, but slight improvement on trial 5. |
| Trial 7 | Very fine streaks, but slight improvement on trial 6. |
| Trial 8 | Fine streaks with evidence of dye spots. |
| Trial 9 | Less defined streaks than trial 8. |
| Trial 10 | Very fine streaks, similar to trial 7. |
| Trial 11 | Slight streaks, best so far. |
| Trial 12 | Slightly more streaks than trial 11. |
| Trial 13 | Slight streaks, similar to trial 11. |
| Trial 14 | Slight streaks, best so far. |
| Trial 15 | Similar to trial 14. |
| Trial 16 | Appears almost perfect. |
| Trial 17 | Good, but not as good as trial 16. |
| Trial 18 | In between trial 16 and 17. |

WCW in Table 5 stands for Wet Coating Weight.

The dye mixture used in Trial 14 exhibited a viscosity of 125 centipoise measured using a Brookfield RVF viscometer equipped with a No. 3 spindle at 20 rpm, and it and the mixtures used in Trials 3–13 and 15–18 satisfy the requirements for use in the present invention. The dye mixtures used in Trials 1 and 2, on the other hand, exhibited viscosities of around 1000 centipoise and Trials 1 and 2 were therefore comparative examples not according to the invention, whereas Trials 3–18 illustrate the process of the invention.

Film shrinkage during the heating step was measured. Shrinkage in the machine direction was greater when the heating step was carried out at higher temperatures and for longer times. Shrinkage in the machine direction was 1.0% for temperatures in the range 160–175° C. and times in the range 10–60 seconds. Shrinkage in the machine direction at a temperature of 180° C. was 1.0% for times in the range 10–30 seconds and 2.0% for a time of 60 seconds. Shrinkage in the cross direction was zero in every case.

EXAMPLE 5

Polyester film was dyed to a charcoal shade of 35% transmission either by a solvent-assisted technique (ethylene glycol) according to the prior art or by the method of the invention. The dyed films were then exposed in a zenon weatherometer for 500 hours and the change in colour (degree of fading) assessed using a spectrophotometer. The film dyed according to the invention was exposed with either its dyed or its undyed surface towards the light source. The results were as follows (delta E, wherein a lower value indicates a lesser change in colour):

| | |
|---|---|
| Prior art control | 7.03 |
| Dyed surface towards light | 9.96 |
| Undyed surface towards light | 3.76 |

The film prepared according to the invention therefore showed excellent resistance to weathering when its undyed surface was exposed to the light.

EXAMPLE 6

One side of a polyester film was coated by reverse gravure printing with a dispersion containing 11.4 parts by weight C.I. Disperse Blue 60 liquid dyestuff, 88.6 parts by weight of a thickener which was an 1% aqueous solution of CMC and 20 parts by weight IPA. The thickener had a viscosity measured at ambient temperature using a Brookfield RVT viscometer of about 25–30 centipoise and the dispersion a viscosity of about 35 centipoise. The coated film was heated to dry the coating layer so formed. The other side of the film was coated in similar manner with a dispersion containing 2.7 parts by weight C.I. Disperse Red 60 liquid dyestuff, 0.9 parts by weight C.I. Disperse Yellow 54 liquid dyestuff, 96.4 parts by weight of the same thickener and 20 parts by weight IPA, and then dried. The coated film was further heated to cause the blue dyestuff to migrate into one side of the film and to cause the red and yellow dyestuffs to migrate into the other side of the film, washed, and dried. The resulting dyed film exhibited a uniform charcoal colour.

EXAMPLE 7

A polyester film was coated by reverse gravure printing with a dispersion containing 25 parts by weight C.I. Disperse Violet 57 liquid dyestuff, 75 parts by weight of the thickener described in Example 6, and 20 parts by weight IPA. The coated film was dried, further heated to cause the dyestuff to migrate into the film, washed, and dried. The resulting high quality dyed film exhibited an optical transmission of 3%.

EXAMPLE 8

A polyester film was coated by reverse gravure printing with a mixture containing 60 parts by weight C.I. Disperse Yellow 54 liquid dyestuff, 45 parts by weight C.I. Disperse Red 60 liquid dyestuff and 5000 parts by weight of the thickener described in Example 6. The film was heated in an oven at 90° C. to dry the dye layer. Coating was carried out successfully at 100, 200 and 400 ft/min. The dried film was then further heated at 190° C. for 100 sec to cause the dyestuffs to migrate into the film. The dyed film was metallised on the undyed side with aluminium by vacuum vapour deposition. The resulting high quality film was opaque with an Optical Density of 3. It appeared silver when examined from the metallised side and yellow from the dyed side.

COMPARATIVE EXAMPLE 1

Dispersol Blue C-3R (a liquid disperse dyestuff available from ICI plc) was coated onto a sample of polyester film 25 micron thick by drawing a wire-wrapped stainless steel rod (metering rod) over the film to simulate gravure printing. (Dispersol is a Trade Mark of ICI plc.) The apparatus used was a K Control Coater 101 available from R.K. Print-Coat Instruments Limited, Litlington, Hertfordshire, U.K. equipped with Bar No. 3 (K-Bar 3). This bar was wound with wire of 0.31 mm diameter and is specified as providing a wet film deposit 24 micron thick. Dispersol Blue C-3R exhibited a viscosity of 1200 centipoise measured using a Brookfield viscometer with a No.5 spindle at 20 rpm. The viscosity of this dyestuff is high due to its high solids content. No thickener was added in this Example. The wet film was air-dried. The Quality Index of the dried coating was assessed to be 1. The film was then heated at 200° C. for 30 seconds to cause migration of the dye into the film and then washed with water. The wash liquors contained a commercially unacceptable large amount of dyestuff which had not migrated into the film. The dyed film was intensely coloured and its Quality Index was assessed to be 10. It is believed that the Quality Index of the film was much better than that of the dried layer only because the layer contained a large excess of dyestuff.

COMPARATIVE EXAMPLE 2

A stock solution of thickener was made by dissolving 2 parts SCMC in 98 parts water. The SCMC used was Courlose F-350 available from Courtaulds plc. The stock solution exhibited a viscosity of 2000 centipoise. 3 parts Dispersol Blue C-3R and 97 parts stock solution were mixed to produce a dye mixture having a viscosity of about 2000 centipoise. Polyester film was coated with this dye mixture using the same conditions as in Comparative Example 1. The film was air-dried, heated at 165° C. for times between 30 seconds and 2 minutes to cause migration of the dyestuff into the film, and washed with water. The Quality Index of the dyed film for all times in the range 30 seconds to 2 minutes was assessed to be 2.

COMPARATIVE EXAMPLE 3

1 part Dispersol Blue C-3R and 99 parts water were mixed to produce a dye mixture having a viscosity close to that of water (1 centipoise). Polyester film was coated with this dye mixture using the same conditions as in Comparative Example 1. The film was air-dried. The dried layer did not adhere well to the film. The dried film was heated at 180° C. for 30 seconds to cause migration of the dyestuff into the film, and washed with water. The Quality Index of the dyed film was assessed to be 1.

What is claimed is:

1. A process for producing a coloured polyester film including the steps of:

(1) providing a dye mixture which has a viscosity of no more than 500 centipoise at ambient temperature and which is a suspension of at least one disperse dyestuff in a solution of a thickener in water;

(2) coating said dye mixture onto a polyester film to form a layer;

(3) heating said film to a temperature to cause said at least one dyestuff to migrate from said layer into said film;

wherein said dyestuff does not sublime at said temperature which causes the dyestuff to migrate into the film.

2. A process according to claim 1, wherein said dye mixture has a viscosity of no more than 100 centipoise.

3. A process according to claim 1, wherein said dye mixture has a viscosity of at least 2 centipoise.

4. A process according to claim 1, wherein the total solids content of said dye mixture is in the range 2 to 10 percent by weight.

5. A process according to claim 1, wherein said thickener is a water-soluble cellulose ether, a poly(vinyl alcohol), an alginate, or a carboxymethyl cellulose.

6. A process according to claim 1, wherein said solution additionally comprises an organic liquid which is at least partially miscible with water.

7. A process according to claim 6, wherein the boiling point of said organic liquid is in the range 70 to 120° C.

8. A process according to claim 6, wherein the proportion of said organic liquid in said dye mixture is in the range 10 to 25 percent by weight.

9. A process according to claim 6, wherein said organic liquid is isopropyl alcohol.

10. A process according to claim 1, wherein the average particle size of said at least one disperse dyestuff is less than about 1 micron.

11. A process according to claim 1, wherein said coating step further comprises applying said dye mixture onto said film as said film moves over a gravure printing roll in a gravure printing process.

12. A process according to claim 1, additionally including the step of drying said layer to form a dried layer prior to the step of heating said film to cause said dyestuff to migrate from said layer into said film.

13. A process according to claim 1, wherein said heating is carried out in an oven at a temperature in the range 160 to 180° C.

14. A process according to claim 1, additionally including the step of washing said film with water subsequent to said heating.

15. A process according to claim 14, additionally including the step of washing said film with a water-miscible organic solvent subsequent to said heating and prior to said washing with water.

16. A process according to claim 1 wherein no swelling agent is present in the dye mixture.

17. A process according to claim 1 further comprising metallizing a first or second surface of said film.

* * * * *

UNITED STATES PATENT AND TRADEMARK OFFICE

CERTIFICATE OF CORRECTION

PATENT NO. : 6,221,112 B1
DATED : April 24, 2001
INVENTOR(S) : W. Snider

It is certified that error appears in the above-identified patent and that said Letters Patent is hereby corrected as shown below:

Column 5,
Line 43, replace "sped" with -- speed --.

Column 8,
Line 36, replace "90" with -- 80 --.

Column 11,
Line 21, replace "as" with -- was --.

Column 14,
Line 20, replace "These" with -- The --.

Column 18,
Line 35, Example 8, replace "100" with -- 10 --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*